US008811871B2

(12) United States Patent
Yamana

(10) Patent No.: US 8,811,871 B2
(45) Date of Patent: Aug. 19, 2014

(54) FIXING DEVICE AND IMAGE FORMING APPARATUS USING THE SAME

(75) Inventor: Shinji Yamana, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/353,691

(22) Filed: Jan. 19, 2012

(65) Prior Publication Data

US 2012/0213562 A1 Aug. 23, 2012

(30) Foreign Application Priority Data

Feb. 18, 2011 (JP) ..... 2011-032728

(51) Int. Cl.
*G03G 15/20* (2006.01)

(52) U.S. Cl.
CPC .... *G03G 15/2064* (2013.01); *G03G 2215/2032* (2013.01); *G03G 15/2085* (2013.01)
USPC ..... 399/329; 399/328; 399/331; 399/332

(58) Field of Classification Search
CPC ..... G03B 15/20
USPC ..... 399/130–342
See application file for complete search history.

(56) References Cited

U.S. PATENT DOCUMENTS

| | | | | |
|---|---|---|---|---|
| 5,481,349 | A | 1/1996 | Satoh et al. | |
| 6,088,549 | A | 7/2000 | Kagawa et al. | |
| 6,496,666 | B2 * | 12/2002 | Hayashi et al. | 399/69 |
| 6,980,763 | B2 * | 12/2005 | Murai et al. | 399/329 |
| 7,003,253 | B2 | 2/2006 | Uchida et al. | |
| 7,299,000 | B2 * | 11/2007 | Taira et al. | 399/322 |
| 7,860,419 | B2 | 12/2010 | Tateishi et al. | |
| 2003/0147680 | A1 * | 8/2003 | Kawamura et al. | 399/329 |
| 2004/0081491 | A1 | 4/2004 | Uchida et al. | |
| 2006/0210327 | A1 * | 9/2006 | Iwakura et al. | 399/313 |
| 2008/0063419 | A1 | 3/2008 | Tateishi et al. | |
| 2009/0285610 | A1 * | 11/2009 | Edahiro | 399/329 |
| 2009/0304419 | A1 * | 12/2009 | Roof et al. | 399/323 |

FOREIGN PATENT DOCUMENTS

| | | | | |
|---|---|---|---|---|
| CN | 1499312 | A | 5/2004 | |
| CN | 101145019 | A | 3/2008 | |
| JP | 06-175527 | A | 6/1994 | |
| JP | 10-133505 | | 5/1998 | |
| JP | 2007-193121 | * | 8/2007 | G03G 15/20 |
| JP | 2010-204623 | A | 9/2010 | |
| JP | 2011-002590 | | 6/2011 | |

* cited by examiner

*Primary Examiner* — Clayton E Laballe
*Assistant Examiner* — Kevin Butler
(74) *Attorney, Agent, or Firm* — Renner, Otto, Boisselle & Sklar, LLP

(57) ABSTRACT

Provided are a fixing device and an image forming apparatus provided with the same, which prevent the winding of a small paper having a light weight on a fixing belt, and also prevents paper blockage and paper curling. A detachment angle, which is defined by a tangent line of a fixing roller and a paper conveying direction at a paper exit point of a fixing nip portion where the fixing roller and a pressing roller pressure-contact with each other, is kept at 23 degrees or more, and a sheet of paper passes through the fixing nip portion, and a setting temperature of the pressing roller is increased step by step in accordance with the number of the sheet of paper by a heater lamp provided in an inside of the pressing roller.

3 Claims, 8 Drawing Sheets

*FIG. 4*

6 4 200 32 20 29 31

| Fixing Roller | | | Pressing Roller | | | Nip Load (kgf) | Detach-ment Angle (degrees) | Paper Basis Weight(g) | Detachment Property Judgement |
|---|---|---|---|---|---|---|---|---|---|
| Diameter | Rubber Thickmess | Dardness | External Diameter | Rubber Thickness | Hardness | | | | |
| Φ30 | 5mm | 44° | Φ30 | 2mm | 72° | 22.3 | 16 | 75 | OK |
| ↑ | | ↑ | ↑ | ↑ | ↑ | 31.2 | 19 | 68 | OK |
| ↑ | ↑ | ↑ | ↑ | ↑ | ↑ | 26.7 | 17.3 | 68 | NG |
| ↑ | ↑ | ↑ | ↑ | ↑ | ↑ | 40.1 | 20.3 | 60 | OK |
| ↑ | ↑ | ↑ | ↑ | ↑ | ↑ | 35.6 | 19.7 | 60 | NG |
| ↑ | ↑ | ↑ | ↑ | 1mm | 81° | 49.0 | 23.3 | 56 | OK |
| ↑ | ↑ | ↑ | ↑ | ↑ | ↑ | 40.1 | 21.9 | 56 | NG |
| ↑ | ↑ | 49° | ↑ | ↑ | ↑ | 40.1 | 19.9 | 56 | NG |
| ↑ | ↑ | ↑ | ↑ | ↑ | ↑ | 57.9 | 23.0 | 56 | OK |
| ↑ | ↑ | 24° | ↑ | ↑ | ↑ | 40.1 | 29.2 | 56 | OK |
| ↑ | ↑ | ↑ | ↑ | 3mm | 57° | 40.1 | 23.1 | 56 | OK |
| ↑ | ↑ | ↑ | ↑ | ↑ | ↑ | 40.1 | 19.4 | 56 | NG |
| ↑ | ↑ | ↑ | ↑ | ↑ | ↑ | 31.2 | 19.4 | 68 | OK |
| Φ40 | ↑ | 24° | Φ40 | 1mm | 81° | 40.1 | 24.1 | 56 | OK |
| ↑ | ↑ | ↑ | ↑ | 2mm | 72° | 40.1 | 21.7 | 56 | NG |

33a 34a 35a 33b 34b 35b

FIG. 10

| 34b Rubber Thickness (mm) | 36 Temperature Drop | 37 Satin Unevenness | 38 Comprehensive Evaluation |
|---|---|---|---|
| 0. 3 | Good (20 degrees) | Not Good | Not Good |
| 0. 5 | Good (20 degrees) | Fair | Good |
| 1. 0 | Good (25 degrees) | Good | Good |
| 1. 5 | Fair (30 degrees) | Good | Good |
| 2. 0 | Not Good (35 degrees) | Good | Not Good |

FIXING DEVICE AND IMAGE FORMING APPARATUS USING THE SAME

This Nonprovisional application claims priority under 35 U.S.C. §119(a) on Patent Application No. 2011-032728 filed in Japan on 18 Feb. 2011, the entire contents of which are hereby incorporated by reference.

BACKGROUND OF THE INVENTION

1. Field of the Invention

The present invention relates to an electrophotographic image forming apparatus such as a copier, a printer or a facsimile, and more specifically, to a fixing device which supplies a toner to an electrostatic latent image formed on a photoreceptor drum and thermally fuses a developed toner image to fix the toner image to a recoding medium, and an image forming apparatus provided with the same.

2. Description of the Prior Art

Electrophotographic image forming apparatuses (e.g., printers, etc.) are provided with a fixing device which thermally fuses a toner image formed on a recording medium (a recording sheet of paper or a sheet of paper) to fix the toner image to the sheet of paper. As one example of the fixing device, a fixing device of a paired roller type made up of a fixing roller and a pressing roller has been known, as shown in Patent Literature 1.

The fixing roller is a roller member in which an elastic layer is formed on the surface of a hollow metal core made of aluminum or the like and configured with a halogen lamp as a heating source arranged inside the metal core. A temperature control device carries out on/off control of the halogen lamp in accordance with signals output from a temperature detecting portion provided on the surface of the fixing roller so as to control a temperature of the surface of the fixing roller.

The pressing roller is a roller member in which a heat-resistant elastic layer of silicone rubber or the like is provided on the metal core as a coating layer. This pressing roller is put in pressure-contact with the peripheral surface of the fixing roller so that the above elastic layer of the pressing roller is elastically deformed, thereby forming a fixing nip area (fixing nip portion) between the fixing roller and the pressing roller.

With the above configuration, in the fixing device, a sheet of paper having an unfixed toner image formed thereon is sandwiched in the fixing nip area between the fixing roller and the pressing roller and the above sheet of paper is conveyed by rotating these two rollers while the toner image on the sheet of paper is fused by heat from the peripheral surface of the fixing roller and fixed to the sheet of paper.

Corresponding to the higher performance of an image forming apparatus, it is necessary to make a width of the fixing nip area (nip width) wider in a width direction of a conveying direction of a recording medium. An example of a method of widening the nip width includes increasing a thickness of the elastic layer of the fixing roller or increasing a diameter of the fixing roller. However, the heat conductivity of the elastic layer of the fixing roller is so high that in a case where the thickness of the elastic layer is increased, it takes longer time to warm up in the operation of increasing the temperature to a predetermined temperature at which the image forming apparatus is operable.

Moreover, in the fixing device of a paired roller type, after the power is turned on first in the morning, the fixing roller and the pressing roller are under the room temperature condition, and it is necessary to increase the temperature to the predetermined temperature after the power is turned on, so that it takes long time to warm up. Further, in a waiting mode where no copying operation is performed, it is necessary to keep the roller surface at a predetermined temperature, thus heating should be performed at all times even when no copying operation is performed, so that energy is wastefully consumed in addition to copying operations.

Further, when a process speed of the image forming apparatus is increased, a fixing temperature fails to follow the temperature of the fixing roller. On the other hand, when a diameter of the fixing roller is increased, power consumption is increased in a heating portion such as a halogen lamp used for heating.

According to Patent Literature 1 (Japanese Patent Application Laid-Open No. 1998-133505), there has been proposed a technology to perform image formation in which a sponge having a small heat capacity is used for a rubber layer in a fixing roller in order to realize fast heat properties in belt fixing, and fixing is carried out by securing a nip width of a pressing roller whose a rubber layer is thickened and softened so as to decrease a fixing temperature.

However, according to the fixing by the fixing roller of a fixing device in Patent Literature 1, there is a problem in that the repulsion of the rubber layer which is effective in detaching off a sheet of paper can not sufficiently be obtained for a fixing belt to lower detachment properties of a sheet of paper. Thus, a sheet of paper needs to be detached off in accordance with the curvature of the pressing roller so that the sheet of paper is discharged toward the pressing roller side at an exit point of a fixing nip portion (an end portion of the fixing nip portion in a paper conveying direction), however, as the discharge of the sheet of paper is directed toward the pressing roller side, degrees of curling (warp) of the sheet of paper become larger. In particular, when a fixing operation is performed for a sheet of paper whose basis weight is small, there is a problem in that the sheet of paper winds around the fixing belt so as to cause malfunctions or a jam (paper blockage) occurs.

SUMMARY OF THE INVENTION

The present invention has been achieved in view of the circumstances described above, and aims to provide a fixing device and an image forming apparatus provided with the same, which prevent the winding of a small paper having a light weight on a fixing belt, and also prevents paper blockage and paper curling.

The fixing device according to the present invention to solve the problems described above and the image forming apparatus provided with the same are configured as follows:

The fixing device of the present invention includes; an endless-shaped fixing belt for conveying a recording medium; a heating roller for heating the fixing belt; a fixing roller having an elastic layer formed on an outer peripheral surface thereof; and a pressing roller which pressure-contacts with the fixing roller through the fixing belt, wherein the recording medium passes through a nip portion where the pressing roller and the fixing roller pressure-contact with each other while rotating, so as to fix an unfixed toner image on the recording medium, and wherein a detachment angle formed by a tangent line of the fixing roller and a conveying direction of the recording medium is kept at 23 degrees or more at an exit point of the nip portion relative to the conveying direction of the recording medium.

Further, the fixing device of the present invention is characterized in that the pressing roller includes a heating portion in an inside thereof, and a setting temperature of the pressing roller is increased step by step in accordance with the number of the recording medium.

Further, it is characterized in that the pressing roller includes an elastic layer and a thickness of the elastic layer ranges from 0.5 mm to 1.5 mm.

Further, the image forming apparatus of the present invention includes; an optical scanning device for deflecting and scanning a laser beam; a photoreceptor drum having an electrostatic latent image formed thereon by the laser beam irradiated by the optical scanning device; a developing portion for attaching a developer to the electrostatic latent image formed on the photoreceptor drum to develop the electrostatic latent image; and a transfer portion for transferring the developer attached by the developing portion on a recording medium; and a fixing device, wherein as a fixing device, the fixing device above is used.

According to the present invention, The fixing device of the present invention includes; an endless-shaped fixing belt for conveying a recording medium; a heating roller for heating the fixing belt; a fixing roller having an elastic layer formed on an outer peripheral surface thereof; and a pressing roller which pressure-contacts with the fixing roller through the fixing belt, wherein the recording medium passes through a nip portion where the pressing roller and the fixing roller pressure-contact with each other while rotating, so as to fix an unfixed toner image on the recording medium, and wherein a detachment angle formed by a tangent line of the fixing roller and a conveying direction of the recording medium is kept at 23 degrees or more at an exit point of the nip portion relative to the conveying direction of the recording medium, so that the present invention has advantageous effects such that the recording medium is easily separated from the fixing belt so as to improve paper detachment properties and to prevent curling of the recording medium.

According to the present invention, the pressing roller includes a heating portion in an inside thereof, and a setting temperature of the pressing roller is increased step by step in accordance with the number of the recording medium, so that the present invention has advantageous effects such that it is possible to reduce a temperature difference between the fixing belt and the pressing roller and prevent the curling of the recording medium and improve detachment properties at the same time.

According to the present invention, the pressing roller includes an elastic layer and a thickness of the elastic layer ranges from 0.5 mm to 1.5 mm, so that the present invention has advantageous effects such that it is possible to improve heat conductivity and to prevent occurrence of satin-like luster unevenness on the recording medium.

According to the present invention, the image forming apparatus of the present invention includes an endless-shaped fixing belt for conveying a recording medium; a heating roller for heating the fixing belt; a fixing roller having an elastic layer formed on an outer peripheral surface thereof; and a pressing roller which pressure-contacts with the fixing roller through the fixing belt, wherein the recording medium passes through a nip portion where the pressing roller and the fixing roller pressure-contact with each other while rotating, so as to fix an unfixed toner image on the recording medium, and wherein a detachment angle formed by a tangent line of the fixing roller and a conveying direction of the recording medium is kept at 23 degrees or more at an exit point of the nip portion relative to the conveying direction of the recording medium, so that the present invention has advantageous effects such that the recording medium is easily separated from the fixing belt so as to improve paper detachment properties and to prevent curling of the recording medium, so that the present invention has advantageous effects such that the recording medium is easily separated from the fixing belt so as to improve paper detachment properties, prevent curling of the recording medium, and perform image formation without satin-like luster unevenness.

BRIEF DESCRIPTION OF THE DRAWINGS

FIG. 4 is a table showing experimental results for finding out a preferable condition to improve detachment properties of a sheet of paper in the fixing device according to an embodiment of the present invention;

FIG. 10 is a table showing a relation between a drop of a center temperature of the pressing roller and satin unevenness in the fixing device corresponding to each rubber thickness of the pressing roller 4 according to an embodiment of the present invention.

DESCRIPTION OF THE PREFERRED EMBODIMENTS

Figure 1:
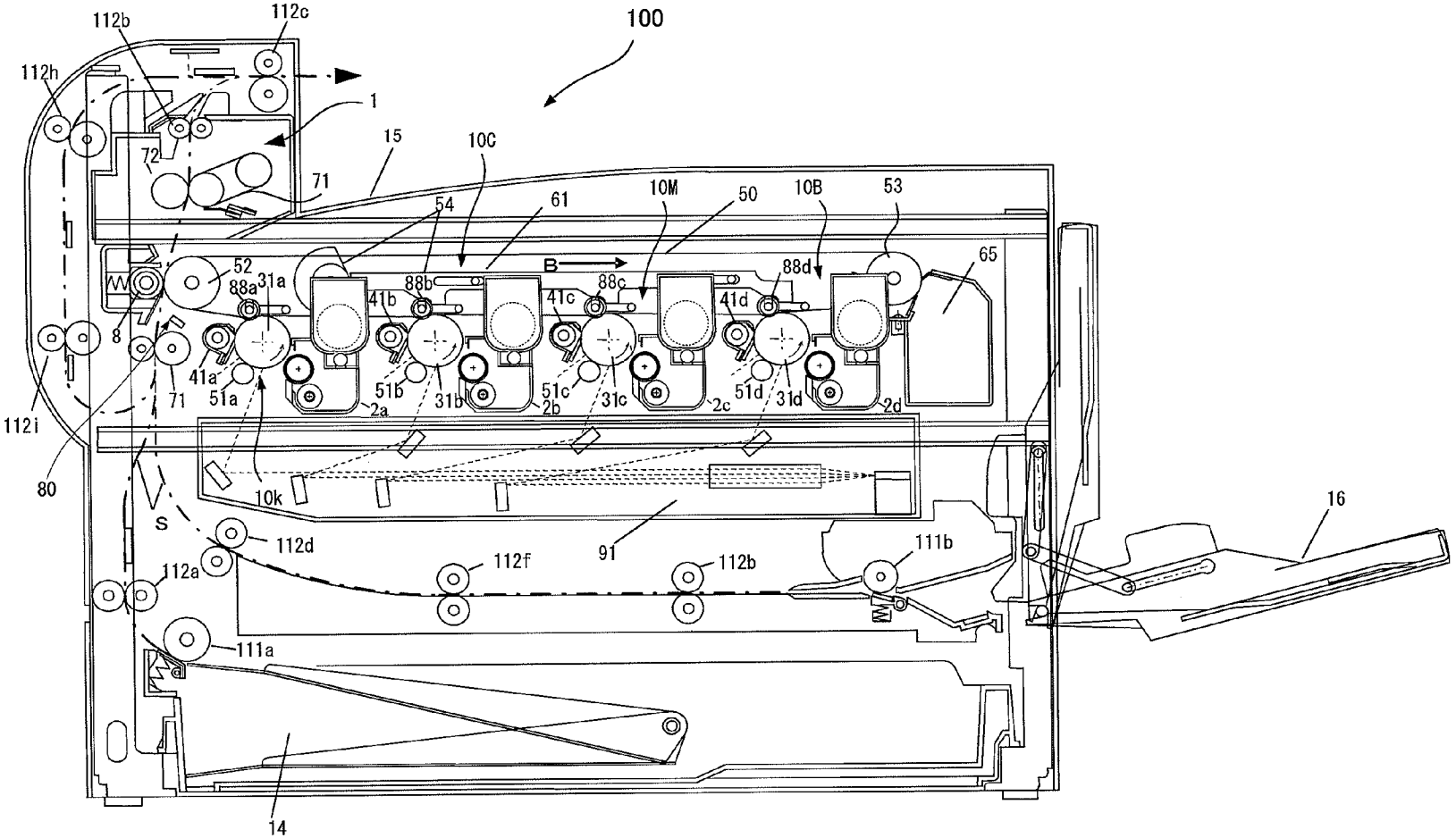
FIG. 1 is a schematic view showing a configuration of an image forming apparatus provided with a fixing device according to an embodiment of the present invention.

Next, description will be given for an image forming apparatus 100 provided with a fixing device 1 according to an embodiment of the present invention. Note that, the present embodiment shows a case where the image forming apparatus is applied to a color multi-functional peripheral. FIG. 1 is a schematic view showing a configuration of the image forming apparatus 100 provided with the fixing device 1 according to an embodiment of the present embodiment.

The image forming apparatus 100 according to the present embodiment forms a multi-color or monochrome image on a recording member (sheet of paper 8) based on an image read from a document or on image data transmitted through a network etc., from outside.

The image forming apparatus 100 is provided with, as shown in FIG. 1, four sets of visual image forming units 10 (10K, 10C, 10M and 10B), the fixing device 1, a paper feed tray 14, a control portion (not shown), an exposure unit 91, an intermediate transfer belt 50, a paper conveying path S, a registration roller 71, a manual tray 16, and a paper discharge tray 15.

The visual image forming units 10 are provided with developing devices 2 (2*a*, 2*b*, 2*c* and 2*d*), photoreceptor drums 31 (31*a*, 31*b*, 31*c* and 31*d*), cleaner units 41 (41*a*, 41*b*, 41*c* and 41*d*), charging devices 51 (51*a*, 51*b*, 51*c* and 51*d*), an intermediate transfer belt 61, a transfer roller 88, a photoreceptor drum driving portion (not shown) and a developing device driving portion (not shown).

In the visual image forming units 10 (10K, 10C, 10M and 10B), image data corresponds to color images using respective colors of black (K), cyan (C), magenta (M) and yellow (Y). Accordingly, four sets each of the developing devices 2 (2*a* to 2*d*), the photoreceptor drums 31 (31*a* to 31*d*), the cleaner units 41 (41*a* to 41*d*), charge erasing devices (not shown) and the charging devices (51*a* to 51*d*) are provided such that four types of electrostatic latent images corresponding to respective colors are formed. In addition, a, b, c and d correspond to black, cyan, magenta and yellow, respectively, and four visual image forming units 10 are disposed. Note that, though a color image is formed using four colors in the present embodiment, multi-color image formation, for example, using six colors, and monochrome image formation are also applicable.

The exposure unit 91 is a laser scanning unit (LSU) using a laser diode in a laser light source. The exposure unit 91 exposes the outer peripheral surfaces of the photoreceptor drums 31 that have been charged uniformly by the charging devices 51 in accordance with input image data so as to form electrostatic latent images corresponding to the above-described input image data on the outer peripheral surfaces of the photoreceptor drums 31. Note that, it may be configured such that a writing head in which light emitting elements such as EL (Electro Luminescence) and LED (Light Emitting Diode) are arranged in an array is used, in place of the laser diode.

The developing device 2 visualizes the electrostatic latent image formed on each of the photoreceptor drums 31 with the toner of black (K), cyan (C), magenta (M) and yellow (Y).

The cleaner unit 41 is provided with a cleaning blade (not shown), which is arranged so as to abut (come into sliding contact with) the outer peripheral surface of the photoreceptor drum 31, and removes and collects the residual toner on the surface of the photoreceptor drum 31 after development and transfer of the electrostatic latent image.

The photoreceptor drum 31 (31*a* to 31*d*) is arranged so that a part of the outer peripheral surface comes into contact with the surface of the intermediate transfer belt 50 while the charging device 51 as an electric field generating portion, the developing device 2, a charge erasing portion 46 and the cleaner unit 41 are arranged along and close to the outer peripheral surface of the drum. Each of the photoreceptor drums 31 is connected to the photoreceptor drum driving portion (not shown) and is rotationally driven under the control of the control portion (not shown). For example, each of the photoreceptor drums 31 is controlled by the control portion individually and independently with a shaft of the photoreceptor drum 31 as a center and controlled by the photoreceptor drum driving portion so as to reduce the speed of rotational driving.

The photoreceptor drum 31 is an organic photoreceptor drum provided with a conductive substrate (thickness of about 1 μm) made of cylindrical aluminum, an undercoat layer (thickness of about 1 μm) provided on the surface of the conductive substrate, a charge generating layer (thickness of about 0.5 μm) in which charges and holes are generated, and a charge transporting layer (thickness of about 20 μm) in which the generated holes move to be neutralized with electrons on the surface of the photoreceptor drum. Note that, in the present embodiment, a polycarbonate resin and a hydrazone charge-transferring agent are used for the charge transporting layer.

When the surface of the photoreceptor drum 31 is charged (e.g., negatively charged) by the charging device 51 and thereafter exposed by the exposure unit 13, electrons and holes are generated in the charge generating layer. The electrons move from the undercoat layer to the conductive substrate made of materials such as aluminum, and the holes move in the charge transporting layer and are neutralized with the electrons on the surface of the photoreceptor drum 31 to form an electrostatic latent image.

In the organic photoreceptor drum, film thickness of photosensitive layers such as the charge generating layer and the charge transporting layer is reduced by abrasion due to usage over a long time period to cause reduction in film thickness of the photoreceptor drum. By the reduction in film thickness, there is a case where charge retentivity of the organic photoreceptor drum is reduced and the surface potential of the organic photoreceptor drum changes due to usage over along time period. In the present embodiment, respective photoreceptor drums 31 and the developing devices 2 are controlled individually, the photoreceptor drums and the developing devices 2 which are not used are driven individually and independently, to thereby prevent occurrence of reduction in film thickness of the photoreceptor drums 31, deterioration of the developing devices 2 and the like, thus making it possible to form an image without uneven density, image fogging and the like due to usage over a long time period.

The charging device 51 is a charging portion for charging the outer peripheral surface of the photoreceptor drum 31 uniformly to a predetermined potential. The charging device 51 is provided with a plate-like discharge electrode (not shown) having a plurality of sharp-pointed projections of serrated configuration, and a screen-like grid electrode (not shown) which adjusts the charged potential of the surface of the photoreceptor drum 31. Note that, though a scorotron type charging device is used as the charging device 51 in the present embodiment, a charge type charging device, a roller type charging device, a brush type charging device or the like may be used in place of the scorotron type charging device.

The charging device 51, when voltage is applied to the discharge electrode, performs corona discharge and charges the surface of the photoreceptor drum 31, as well as when a predetermined grid electrode is applied to a grid electrode, making the charged status of the surface of the photoreceptor drum 31 uniform and charging the surface of the photoreceptor drum 31 to a predetermined potential and polarity. In the present embodiment, the surface potential of the photoreceptor drum 31 is set to be −900 V.

The intermediate transfer belt 50 is arranged above the photoreceptor drums 31 and is provided with the intermediate transfer belt 50, an intermediate transfer belt driving roller 52, an intermediate transfer belt driven roller 53, and an intermediate transfer belt cleaning unit 65. Further, the intermediate transfer belt 50 is stretched across the intermediate transfer belt driving roller 52, the intermediate transfer belt driven roller 53, an intermediate transfer belt tension mechanism 54, and intermediate transfer rollers 88 (88*a*, 88*b*, 88*c* and 88*d*) and is rotationally driven in a direction of an arrow B in FIG. 1.

The intermediate transfer belt 50 is provided to abut each of the photoreceptor drums 31. The toner images of the respective colors formed on the photoreceptor drums 31 are sequentially overlapped and transferred onto the intermediate transfer belt 50 to form a color toner image (multi-color toner image) on the intermediate transfer belt 50. Moreover, the intermediate transfer belt 50 is a belt member formed into an endless shape using a film with a thickness of about 100 μm to 150 μm. For materials of the intermediate transfer belt 50, polyimide, polycarbonate, thermoplastic elastomer alloy and the like are mainly used.

The toner images formed on the photoreceptor drums 31 are transferred onto the intermediate transfer belt by the intermediate transfer rollers 88. The intermediate transfer rollers 88 are supported so as to be rotatable by an intermediate transfer roller attaching portion (not shown) of the intermediate transfer belt tension mechanism 54 of the intermediate transfer belt 61 and apply a transfer bias for transferring the toner images formed on the photoreceptor drums 31 onto the intermediate transfer belt 50.

To the intermediate transfer rollers 88, a high-voltage transfer bias (high voltage whose polarity (+) is reverse to the charging polarity (−) of the toner) for transferring the toner images. Each of the intermediate transfer rollers 88 is a roller which has, as its base, a metal (such as stainless-steel) shaft having a diameter of 8 to 10 mm and has a surface covered with a conductive elastic material such as EPDM (Ethylene Propylene Diene Methylene Linkage) and urethane form. Such a conductive elastic material makes it possible to apply a high voltage uniformly to the intermediate transfer belt 50. Note that, in the present embodiment, though a transfer electrode in a roller shape is used as the transfer electrode, instead, brushes and the like are also usable.

In this manner, the electrostatic latent images of respective color hues visualized on the photoreceptor drums 31 are stacked onto the intermediate transfer belt 50, thereby forming an image corresponding to the image data which is input. The toner images thus stacked are conveyed to the location where the transfer roller 88 is arranged by rotating the intermediate transfer belt 50. To the transfer rollers 88, a voltage (high voltage whose polarity (+) is reverse to the charging polarity (−) of the toner) for transferring the toner images onto a recording member (sheet of paper) is applied. In addition, the intermediate transfer belt 50 and the transfer rollers 88 are put in pressure-contact with each other with a predetermined nip pressure. In order for the transfer rollers 88 to constantly obtain the nip pressure, while either one of the transfer rollers 88 or the intermediate transfer belt driving roller 52 are made of a hard material (such as metal), the other is made of a soft material such as an elastic roller (elastic rubber roller or resin foam roller).

Further, the toner adhering to the intermediate transfer belt 50 by contacting with the photoreceptor drums 30 or the toner remaining on the intermediate transfer belt 50 instead of being transferred onto the sheet of paper by the transfer rollers 88 causes a toner color mixture in the next step, and therefore, the toner is removed and collected by the intermediate transfer belt cleaning unit 65. The intermediate transfer belt cleaning unit 65 is provided with a cleaning blade (not shown) as a cleaning member which abuts the intermediate transfer belt 50, and the intermediate transfer belt 50 against which the cleaning blade abuts is supported by the intermediate transfer belt driven roller 62 from the back side.

The charge erasing device (not shown) performs charge erasing processing for the sheet of paper 8 when passing through a contact area of the photoreceptor drum 31 and the intermediate transfer belt 50. As a charge erasing method by the charge erasing device, an electric field whose polarity is opposite to that of a transfer electric field is applied to the intermediate transfer belt 51.

The paper feed tray 14 is a tray for storing recording medium (sheets of paper) used for image formation and is provided on the lower side of the exposure unit 13. Further, the paper discharge tray 15 provided on the upper part of the image forming apparatus 100 is a tray for placing printed sheets of paper face-down.

Moreover, the image forming apparatus 100 is provided with a paper conveying path S that extends approximately vertically to convey a sheet of paper from the paper feed tray 14 to the paper discharge tray 15 by way of the transfer rollers 88 and the fixing device 1. Further, arranged in the vicinity of the paper conveying path S from the paper feed tray 14 to the paper discharge tray 15 are pickup rollers 111 (111*a* and 111*b*), the registration roller 71, the transfer rollers 88, the fixing device 1, and conveying rollers 112 (112*a* to 112*i*).

The conveying roller 112 is a small roller for promoting/assisting conveyance of a recording medium (sheet of paper) and is provided in a plurality of locations along the paper conveying path S. The pickup roller 111*a* is provided at an end portion of the paper feed tray 14, and is a pick-up roller that supplies sheets of paper from the paper feed tray 14 one by one to the paper conveying path S.

The registration roller 71 is a roller which temporarily holds a sheet of paper conveyed in the paper conveying path S. The control portion rotates the registration roller 71 again to time the right moment of next conveyance by halting the sheet of paper conveyed along paper conveying path S at the predetermined location. The sheet of paper is conveyed to a transfer portion having the transfer roller 88 so that the location of the leading edge of the sheet of paper coincides with the location of the leading edge of the image formed on the outer periphery of the photoreceptor drum 31.

The manual tray 16 is used mainly when an irregular sized sheet of paper is set manually for performing printing and is arranged on the side surface of the image forming apparatus 100.

The control portion (not shown) controls operations in the image forming apparatus 100. Further, the control portion is comprised of a microcomputer, a ROM (Read Only Memory) which stores a control program showing procedure of processing executed by the microcomputer, a RAM (Random Access Memory) which provides a work area for working, an EEPROM (Electronically Erasable Programmable ROM) non-volatile memory which temporarily stores an accumulative toner replenishment time which is calculated, an input circuit which is a circuit for inputting signals from a switch (not shown) and includes an input buffer and an A/D conversion circuit, an output circuit which includes a motor and a driver for driving a solenoid and a lamp etc., and the like. Note that, these storage means are collectively referred to as a storage portion (not shown).

In the image forming apparatus 100, operations are carried out by adjusting conditions of various processing in order to obtain a constant toner density and image output without being affected by temporal change of the photoreceptor drums and the developer as time passes. This adjustment is referred to as process control. To be more specific, a charged potential, an exposure amount, a correction amount of a toner density, a development bias value, a transfer voltage value, a fixing temperature and the like are adjusted. Note that, the process control is performed by a process control portion (not shown).

Figure 2:
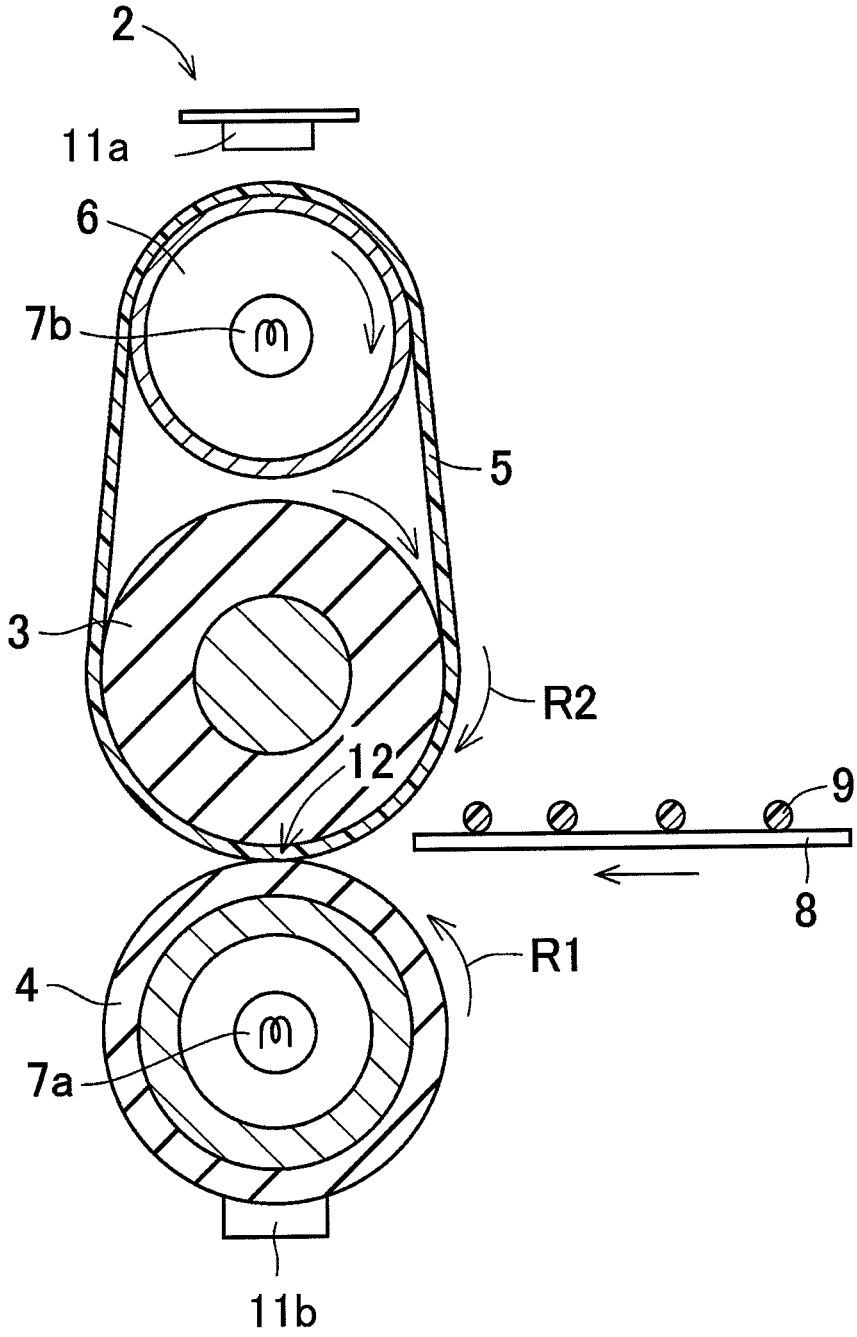
FIG. 2 is a schematic view showing a configuration of the fixing device according to an embodiment of the present invention.
Figure 3:
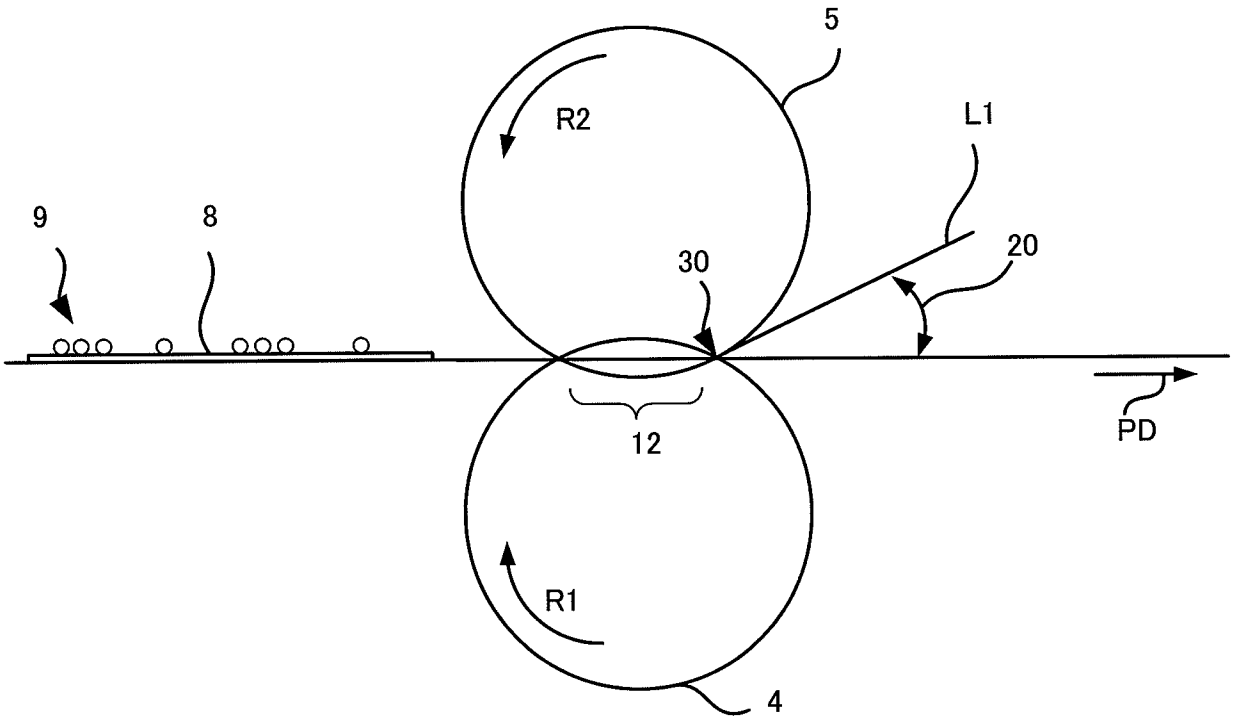
FIG. 3 is a schematic view showing a detachment angle in a fixing nip portion of the fixing device according to an embodiment of the present invention.

Next, description will be given in detail for the fixing device 1 according to an embodiment of the present invention with reference to FIGS. 2 and 3. FIG. 2 is a schematic view of the fixing device 1 according to the embodiment of the present invention. FIG. 3 is a schematic view showing a detachment angle 20 in a fixing nip portion 12 of the fixing device 1 according to a first embodiment of the present invention.

The fixing device 1 according to the present embodiment fixes an unfixed toner image 9 formed on the surface of a recording medium (sheet of paper 8) to the recording medium by heating as shown in FIG. 2.

The fixing device 1 according to the present embodiment is provided with a fixing roller 3, a pressing roller 4, a fixing belt 5, a heating roller 6, heater lamps 7*a* and 7*b*, and a first thermistor 11*a* and a second thermistor 11*b*.

The fixing roller 3 has a substantially cylindrical shape and has a two-layer structure in which a metal core and an elastic layer are formed from a substantially cylindrical center shaft to the outer periphery. For the metal core, a metal such as iron, stainless steel, aluminum, or copper, an alloy thereof, or the like is used. For the elastic layer, a heat-resistant rubber material such as silicone rubber or fluorine rubber is used. In the present embodiment, the fixing roller 3 has a diameter of about 30 mm. Stainless steel with a diameter of 20 mm is used for the metal core and silicone sponge rubber with a thickness of 5 mm is used for the elastic layer.

The fixing roller 3 is provided so as to be rotatable about the substantially cylindrical center shaft, and is driven to rotate by the rotation of the pressing roller 4. When the fixing roller 3 is put in pressure-contact with the pressing roller 4 through the fixing belt 5, the fixing nip portion 12 where the fixing roller 3 and the pressing roller 4 abut against each other through the fixing belt 5 is formed. The fixing roller 3 rotates in a direction of an arrow R2 shown in FIGS. 2 and 3, which is opposite to the direction of the pressing roller 4.

The pressing roller 4 has a substantially cylindrical shape and has a three-layered structure in which a metal core, an elastic layer and a release layer are formed from a substantially cylindrical center shaft to the outer periphery. For the metal core, a metal such as iron, stainless steel, aluminum, or copper, or an alloy thereof is used. For the elastic layer, a heat-resistant rubber material such as silicone rubber or fluorine rubber is used. For the release layer, a fluorine resin such as PFA (a copolymer of tetrafluoroethylene and perfluoroalkyl vinyl ether) or PTFE (polytetrafluoroethylene) is used. Specifically, the pressing roller 4 has a diameter of 30 mm. Moreover, iron (STKM) having a diameter of 26 mm and a thickness of 1 mm is used for the metal core. Solid silicone rubber having a thickness of 1 mm is used for the elastic layer. A PFA tube having a thickness of 50 μm is used for the release layer.

Further, the pressing roller 4 is provided so as to be rotatable about the substantially cylindrical center shaft. The pressing roller 4 is a roller-like member which is rotationally driven by a driving motor which is a not-shown driving portion.

The heater lamp 7*a* is arranged in an interior of the pressing roller 4 and heats the pressing roller 4. A temperature of the pressing roller 4 is detected by the thermistor and the control portion (not shown) supplies power from a power supply circuit (not shown) to the heater lamp, whereby the heater lamp 7*a* emits as to radiate infrared rays. In the pressing roller 4, the inner peripheral surface of the pressing roller 4 absorbs the infrared rays radiated from the heater lamp 7*a*, such that the entire pressing roller 4 is heated. In the present embodiment, the heater lamp 7*a* with rated power of 500 W is used. Similarly, the heater lamp 7*b* is arranged in an interior of the heating roller 6 and heats the heating roller 6. The heater lamp 7*b* is controlled by the control portion. The heater lamp 7*b* will be described below.

The fixing belt 5 is an endless-shaped belt and is formed by a cylindrical hollow substrate made of a heat-resistant resin such as polyimide, and a metal material such as stainless steel or nickel. The fixing belt 5 has a diameter of 50 mm when it is not mounted. On the surface of the substrate, an elastic layer formed of an elastomer material such as silicone rubber having excellent heat resistance and elastic property is formed. On the surface of the elastic layer, a release layer formed of a synthetic resin material serving as a fluorine resin such as PFA or PTFE having excellent heat resistance and releasing property is formed.

The fixing belt 5 is constituted by three layers of a substrate, an elastic layer and a release layer. In the present embodiment, polyimide having a thickness of 50 μm is used for the substrate, silicon rubber having a thickness of 150 μm is used for the elastic layer, and a PFA coat having a thickness of 10 to 15 μm is used for the release layer.

The heating roller 6 has a substantially cylindrical shape and has a three-layered structure in which an infrared ray absorbing layer, a metal core and a protective layer are formed from a substantially cylindrical center shaft to the outer periphery. The infrared ray absorbing layer is formed when a heat-resistant carbon-containing coating material is applied to the inside of the metal core and fired. For the metal core, for example, a metal such as iron, stainless steel, aluminum, or copper, or an alloy thereof is used. For the protective layer, a fluorine resin such as PFA (a copolymer of tetrafluoroethylene and perfluoroalkyl vinyl ether) or PTFE (polytetrafluoroethylene) is suitable. The protective layer prevents the polyimide layer of the fixing belt 5 and the heating roller 6 from being abraded due to contact of the fixing belt 5 and the heating roller 6. In the present embodiment, the heating roller 6 has a diameter of 28 mm, and a carbon black coating material having a thickness of 100 μm is used for the infrared ray absorbing layer. Moreover, hollow aluminum having a diameter of 28 mm and a thickness of 1 mm is used for the metal core. For the protective layer, a PTFE coat having a thickness of 50 μm is used.

In addition, the heater lamp 7*b* for heating the heating roller 6 is arranged in an interior of the heating roller 6. The control portion (not shown) causes power to be supplied from a power source circuit (not shown) to the heater lamp 7*b*, whereby, the heater lamp 7*b* emits light, and infrared rays are radiated from the heater lamp 7*b*. In the heating roller 6, the inner peripheral surface of the heating roller 6 absorbs the infrared rays radiated from the heater lamp 7*b*, such that the entire heating roller 6 is heated. In the present embodiment, the heater lamp 7*b* with rated power of 900 W is used. To the heating roller 6, a predetermined load, for example, 50 N is applied in a direction opposite to a direction in which the fixing roller 3 is arranged from the heating roller 6 side. A tension is given to the fixing belt 5, so that the heating roller 6 rotates with the rotation of the fixing belt 5.

When the sheet of paper 8 having an unfixed toner image formed thereon passes through the fixing nip portion 12, the fixing belt 5 which is heated to a predetermined temperature by the heating roller 6 heats the sheet of paper 8. The fixing belt 5 is supported around the heating roller 6 and the fixing roller 3. The fixing belt 5 is driven by the rotation of the pressing roller 4 and rotates in a direction shown by an arrow R2 shown in FIG. 2. When the pressing roller 4 rotates in a direction of an arrow R1 and the fixing belt 5 rotates in a direction of the arrow R2, the sheet of paper 8 passes through the fixing nip portion 12.

Next, description will be given in detail for a setting condition to improve the detachment properties of the sheet of paper 8 and a setting condition to prevent curling of the sheet of paper 8 in the fixing device 1 of the present invention with reference to FIG. 3.

As shown in FIG. 3, when the fixing roller 3 and the pressing roller 4 are put in pressure-contact with each other, the fixing nip portion 12 is formed. In the present embodiment, a width of the paper conveying direction of the fixing nip portion 12 (hereinafter, referred to as a "nip width") is 7 mm. To the fixing nip portion 12, the sheet of paper 8 which is a member to be fixed with the unfixed toner image 9 carried thereon is fed. The sheet of paper 8 passes through the fixing nip portion 12, such that a toner image is fixed to the sheet of paper 8. When the sheet of paper 8 passes through the fixing nip portion 12, the fixing belt 5 abuts the toner image forming surface of the sheet of paper 8, and the pressing roller 4 abuts the surface of the sheet of paper 8 opposite to the toner image forming surface. The fixing roller 3 and the pressing roller 4 are put in pressure-contact with each other with a predetermined load, for example, 400 N.

FIG. 3 shows that a tangent line L1 of the fixing roller 3 is formed at a paper exit point 30 of the fixing nip portion 12 (an end portion of the fixing nip portion on the side on which the sheet of paper is conveyed) where the fixing roller 3 and the pressing roller 4 are put in pressure-contact with each other.

The detachment angle 20 is defined by an angle formed by a conveying direction PD of the sheet of paper 8 and the tangent line L1 of the fixing roller 3 at the exit point of the fixing nip portion (the end portion of the fixing nip portion in the paper conveying direction).

In the present embodiment, an angle of the detachment angle 20 is optimized to improve the detachment properties of a sheet of paper as well as to prevent curling (warp) of a sheet of paper.

The detachment angle 20 becomes different, depending on diameters and weights of the fixing roller 3 and the pressing roller 4, and hardness of elastic layers formed on outer peripheral portions of the fixing roller 3 and the pressing roller 4. Accordingly, by combining various types of the fixing roller 3 and the pressing roller 4, it is possible to set the optimal detachment angle. The detachment properties of a sheet of paper depend on the detachment angle 20, a paper basis weight 29, a process speed (speed with respect to process control), and a toner amount.

FIG. 4 is a table showing results of experiments carried out to find out a preferable condition to improve the detachment properties of a sheet of paper. In the experiments, the detachment angles 20, the paper basis weights 29, and determinations of the detachment properties of a sheet of paper (detachment property determinations 31) are indicated, when the fixing roller 3, the pressing roller 4, and a nip weight 32 are changed.

Further, comparative examination was made by experiments using different types of the fixing roller 3 and the pressing roller 4 with three parameters (outer diameters 33*a* and 33*b*, rubber thickness 34*a* and 34*b*, and hardness 35*a* and 35*b*) as an index.

In addition, when the sheet of paper 8 winds around the fixing belt 5, luster of the toner image forming surface of the sheet of paper 8 is reduced, or hot offset occurs, the detachment property judgment 39 for malfunctions is made, and a code of NG indicating the malfunctions is shown as shown in FIG. 4. On the other hand, when luster of the toner image forming surface of the sheet of paper 8 is not reduced or hot offset does not occur, so that an image is appropriate, the judgment for appropriate operations is made, and a code of OK indicating the appropriate operations is shown.

Specifically, the experiment has been conducted using a black solid image with a toner amount of 1.0 mg/cm$^2$ and with a process speed of 220 mm/s.

Figure 5:
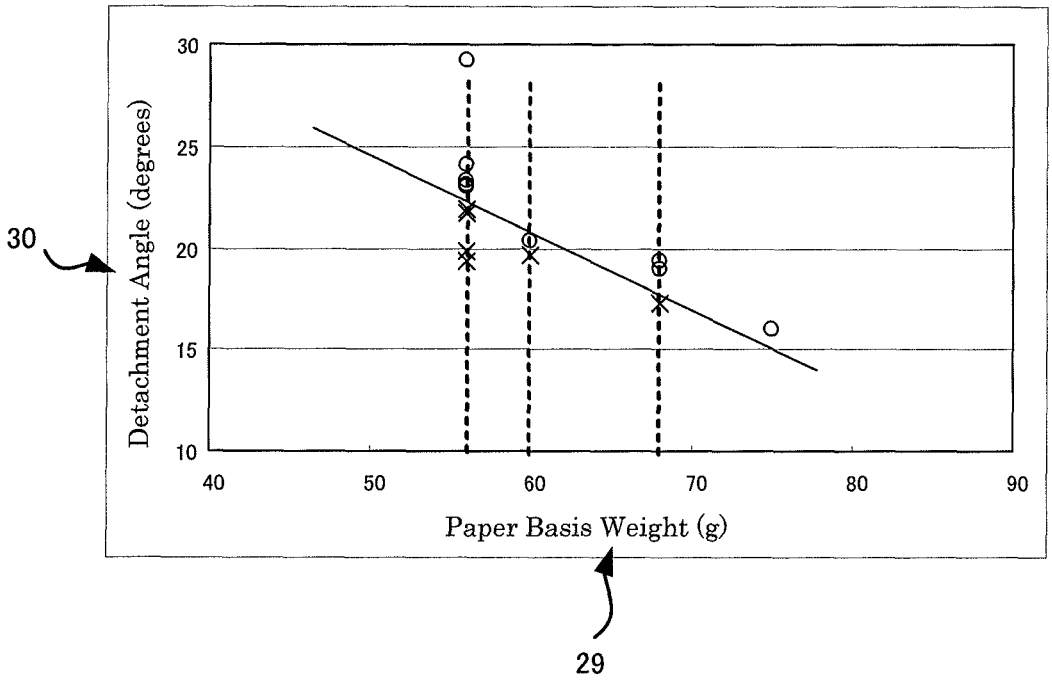
FIG. 5 is a schematic view showing a relation between a detachment angle and a paper basis weight in the fixing device according to an embodiment of the present invention.

FIG. 5 is a schematic view showing a relation between the detachment angle 20 and the paper basis weight 29. In FIG. 5, the vertical axis shows the detachment angle 20 and the horizontal axis shows the paper basis weight 29. In addition, the code of NG indicating any malfunction in the detachment property judgment 39 is represented by "Not Good", the code of OK indicating appropriate operations is represented by "Good", and a relation between the detachment angle 20 and the paper basis weight 29 is shown.

In the experiment described above, it has been found that there exists a critical value of the detachment angle 20 showing the detachment properties of the sheet of paper 8 in accordance with the paper basis weight 29. In the case of the sheet of paper 8 with a basis weight of 60 g, the detachment angle 20 needed to be 20° (degrees) or more. Further, the experiment has found that, in the case of the sheet of paper 8 with a basis weight of 56 g, the detachment angle 20 needed to be 23° or more. Considering that thin sheets of paper are often used as a way of reducing the consumption of sheets of paper, it is preferable that the fixing roller, the pressing roller and the nip load be set in such a manner that the detachment angle 20 is kept at 23° in using the sheet of paper with a basis weight of 56 g.

Note that, in the range of the operation condition under which the relation between the detachment angle 20 and the paper basis weight 29 as shown in FIG. 5 is applicable, the process speed is 170 to 230 mm/s, and the toner amount is 1.1 mg/cm$^2$ or less.

When the toner amount increases or when the process speed increases, the detachment properties are reduced even with the same detachment angle. However, by providing a critical value of the detachment angle separately, it is possible to correspond to the reduction in the detachment properties of a sheet of paper.

Figure 6:
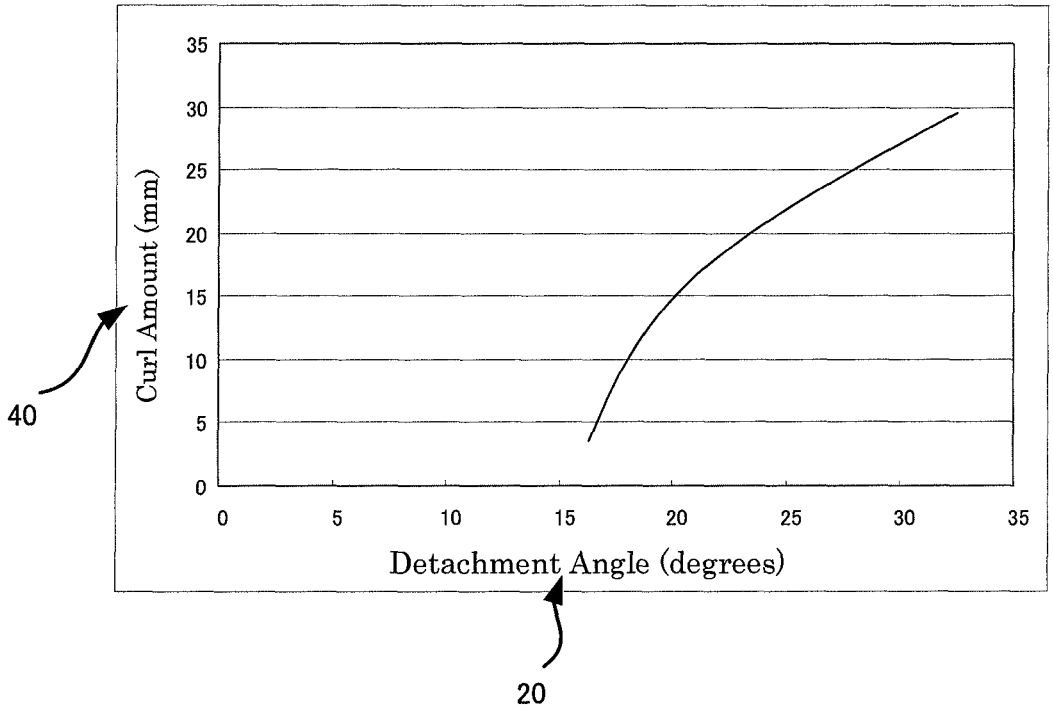
FIG. 6 is a schematic view showing a relation between a detachment angle and a paper curl amount in the fixing device according to an embodiment of the present invention.

FIG. 6 is a schematic view showing a relation between the detachment angle 20 and a paper curl amount 40. In FIG. 6, the vertical axis shows the paper curl amount 40 and the horizontal axis shows the detachment angle 20 to show a relation between the detachment angle 20 and the paper curl amount 40.

As shown in FIG. 6, it is found that as the detachment angle 20 increases, the paper curl amount 40 also increases. In this case, the paper curl amount 40 is a value obtained by averaging out the degree of floating between the leading edge and the rear edge when five sheets of white paper with 68 g are superimposed. When the paper curl amount 40 is large, the number of sheets of paper capable of being stored on the paper feed tray 14 is limited, and there is a risk that a conveyance failure of a sheet of paper is unexpectedly caused.

Figure 7:
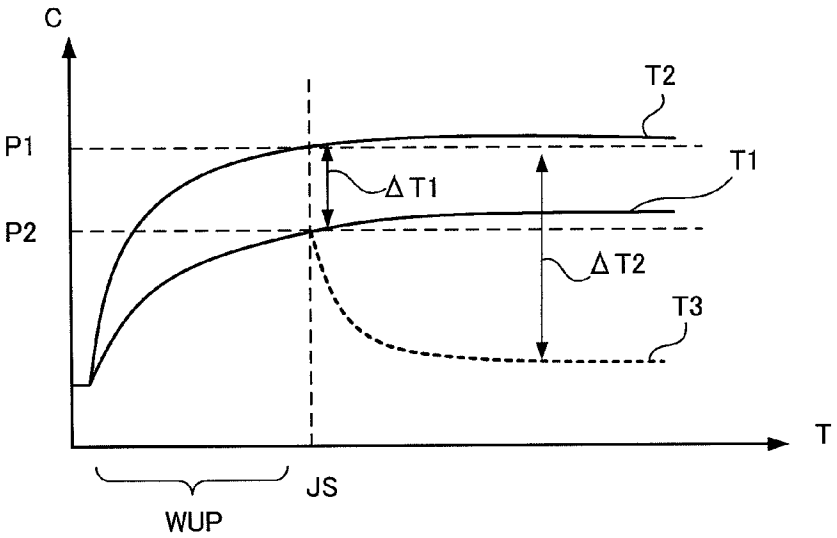
FIG. 7 is an example showing a relation of a temperature difference between a fixing belt and a pressing roller in the fixing device according to an embodiment of the present invention.

Thus, as a method for reducing the paper curl amount 40, it is effective to reduce a temperature difference ΔT between the fixing belt 5 and the pressing roller 4. However, as shown in FIG. 7, during an operation (JOB) for fixing a toner image to a sheet of paper, a detection temperature T1 of the pressing roller 4 by the second thermistor 11*b* (specifically, a center temperature in a center portion of the pressing roller 4) is reduced. The temperature difference Δ1 between the fixing belt 5 and the pressing roller 4 becomes larger as the operation for fixing a toner image to a sheet of paper continues.

Figure 8:
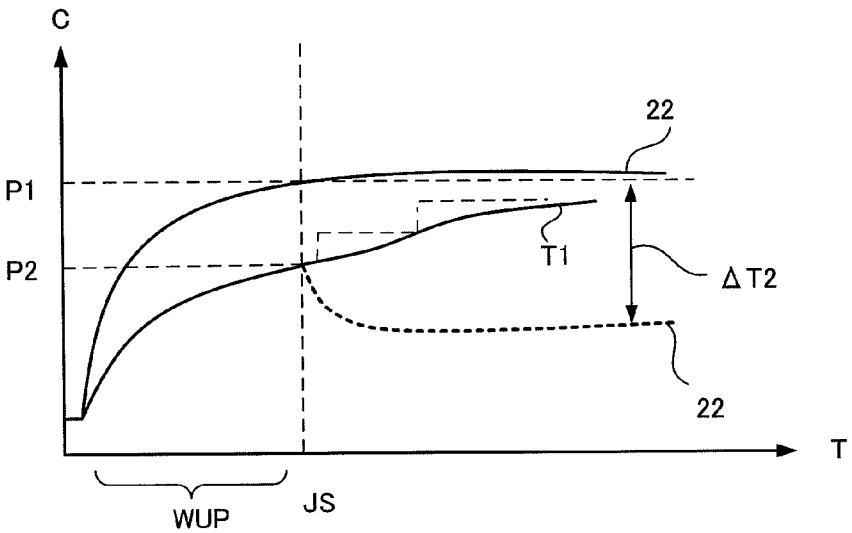
FIG. 8 is an example showing a relation of a temperature difference between the fixing belt and the pressing roller in the fixing device according to an embodiment of the present invention.
Figure 9:
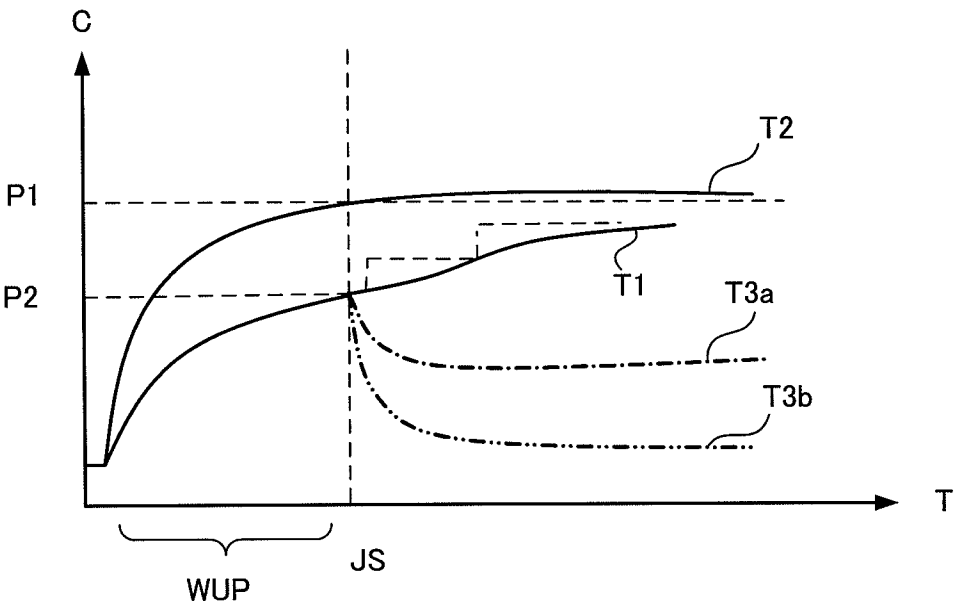
FIG. 9 is an example showing a relation between a temperature difference of the fixing belt and the pressing roller and a thickness of the pressing roller in the fixing device according to an embodiment of the present invention.

Note that, in FIGS. 7 to 9, the horizontal axis shows a time T, the vertical axis shows a temperature C, and a temperature setting value P1 of a fixing belt, a temperature setting value P2 of a pressing roller, an offset term WUP, a temperature T2 of the fixing belt 5, center temperature T3 (T3*a* and T3*b*) in the center portion of the pressing roller 4, a detection temperature T1 of the second thermistor 1*b*, and temperature difference ΔT (ΔT1 and ΔT2) between the fixing belt 5 and the pressing roller 4 are common.

As shown in FIG. 7, it is found that the temperature difference ΔT2 between the fixing belt 5 and the pressing roller 4 after a lapse of a predetermined time of the operation for fixing a toner image to a sheet of paper becomes larger, compared with the temperature difference ΔT1 between the fixing belt 5 and the pressing roller 4 at the time of operation start (JS) to fix a toner image to a sheet of paper.

The second thermistor 11*b* detects the temperature of the pressing roller 4 by contacting, wherein the temperature of a non-paper-passage portion of the end portion of the pressing roller is detected so as to prevent this contact from causing scratches or the like on the contact surface of the pressing roller, and so as not to affect a toner image to be fixed. However, the temperature of the non-paper-passage portion at the edge of the pressing roller 4 is detected. Accordingly, there is a case where the reduction in the temperature of the pressing roller 4 occurs when a sheet of paper passes through the fixing nip portion 12, which cannot correctly be detected.

Thus, as shown in FIG. 8, the temperature of the pressing roller 4 increases step by step and the temperature of a paper-passage portion of the fixing nip portion (center of the fixing nip portion) is eventually maintained. Specifically, based on a predetermined correction value recorded in a storage portion in advance, the control portion (not shown) controls the heat lamp 7*a* to heat the pressing roller 4. With the temperature control of the pressing roller 4, it is possible to suppress the reduction in the temperature of the pressing roller during the operation to fix a toner image to a sheet of paper and to reduce the paper curl amount.

Moreover, when the temperature of the pressing roller 4 step by step increases, the temperature may be increased step by step in accordance with the number of sheets of paper used. According to this setting, it is possible to correspond to the reduction in the temperature of the pressing roller with respect to the fixing operation.

When the control portion adjusts the temperature of the pressing roller 4 by controlling the heat lamp 7*a*, the heat from the heat lamp 7*a* provided in an interior of the pressing roller 4 needs to reach the surface of the pressing roller 4 quickly. The heat conduction speed at the time when the heat reaches the pressing roller 4 becomes different, depending on the thickness of the pressing roller 4. As shown in FIG. 9, it is found that the temperature of the center portion of the pressing roller (center temperature) becomes different, depending on a difference of the thickness of the pressing roller 4.

This is because when the rubber thickness of the pressing roller 4 increases, the heat conduction from the heat lamp 7*a* delays. In order to recover a drop of the temperature of the surface of the pressing roller 4, a longer time and larger electric power are required. As shown in FIG. 9, it is found that when the rubber thickness of 1 mm is thinner than the rubber thickness of 2 mm, the center temperature T3*a* of the pressing roller 4 with the rubber thickness of 1 mm causes less temperature reduction than the center temperature T3*b* of the pressing roller 4 with the rubber thickness of 2 mm.

In the present embodiment, in order to suppress the curl amount of the sheet of paper 8, an upper limit of the temperature difference ΔT between the fixing belt 5 and the pressing roller 4 is defined as 50° or less during the operation (JOB) to fix a toner image to a sheet of paper. Further, considering prevention of hot offset of a first side when both sides of a sheet of paper are printed, a lower limit of the temperature difference ΔT between the fixing belt 5 and the pressing roller 4 is defined as 20°. Thus, the temperature difference ΔT is limited and controlled within the range from 20° to 50°.

FIG. 10 is a table showing a relation between a drop 36 of the center temperature of the pressing roller 4 and satin unevenness 37 corresponding to each rubber thickness 34*b* (0.3 to 2.0 mm) of the pressing roller 4.

As shown in FIG. 10, the drop 36 of the center temperature of the pressing roller 4 is affected by the rubber thickness of the pressing roller 4. When the rubber thickness of the pressing roller 4 is 1.5 mm or less, it is possible to allow the drop 36 of the center temperature of the pressing roller 4 by 30° and to prevent curling of a sheet of paper (paper curling) due to expanding of the temperature difference ΔT between the fixing belt 5 and the pressing roller 4.

Further, when each rubber thickness 34*b* of the pressing roller 4 is 0.5 or more, it is possible to prevent occurrence of irregularities on the surface of an image and satin unevenness which is luster unevenness. Thus, each rubber thickness 34*b* of the pressing roller 4 is preferably 0.5 mm or more. A determination result 38 shown in FIG. 10 indicates the results wherein determination is performed considering the drop 36 of the center temperature of the pressing roller 4 and the satin unevenness 37, and determinations results of "suitability" are represented by "Good", and determination results of "failure" are represented by "Not Good".

By setting the detachment angle 20 and the thickness of the pressing roller 4 based on the detachment angle 20 and the thickness of the pressing roller 4 shown in the present embodiment, the sheet of paper 8 is easily detached from the fixing belt 5, so that the paper detachment properties can be improved and curling of the sheet of paper 8 can be prevented.

What is claimed is:

1. A fixing device comprising:

an endless-shaped fixing belt for conveying a recording medium;

a heating roller for heating the fixing belt;

a fixing roller having an elastic layer formed on an outer peripheral surface thereof; and a pressing roller which pressure-contacts with the fixing roller through the fixing belt, wherein the recording medium passes through a nip portion where the pressing roller and the fixing roller pressure-contact with each other while rotating, so as to fix an unfixed toner image on the recording medium, and a detachment angle formed by a tangent line of the fixing roller and a conveying direction of the recording medium is kept at 23 degrees or more at an exit point of the nip portion relative to the conveying direction of the recording medium, wherein the pressing roller includes:

a heating portion in an inside thereof; and an elastic layer, and wherein a setting temperature of the pressing roller is increased step by step in accordance with the number of the recording medium, and a thickness of the elastic layer of the pressing roller ranges from 0.5 mm to 1.5 mm.

2. The fixing device according to claim 1, wherein the fixing roller is made up of the elastic layer on a surface portion side thereof, and wherein a temperature difference between the fixing roller and the pressing roller is controlled in a range of about 20 degrees Celsius to about 50 degrees Celsius during operation of fixing the unfixed toner image on the recording medium.

3. An image forming apparatus, comprising an optical scanning device for deflecting and scanning a laser beam;

a photoreceptor drum having an electrostatic latent image formed thereon by the laser beam irradiated by the optical scanning device;

a developing portion for attaching a developer to the electrostatic latent image formed on the photoreceptor drum to develop the electrostatic latent image;

a transfer portion for transferring the developer attached by the developing portion on a recording medium; and a fixing device, wherein as a fixing device, the fixing device according to claim 1 is used.

* * * * *